US011889906B2

(12) United States Patent
Burns

(10) Patent No.: US 11,889,906 B2
(45) Date of Patent: Feb. 6, 2024

(54) RECONFIGURABLE CASES FOR PORTABLE HAND-HELD DEVICES AND METHODS

(71) Applicant: KUIU, LLC, Dixon, CA (US)

(72) Inventor: Brendan V. Burns, Bozeman, MT (US)

(73) Assignee: KUIU, LLC, Dixon, CA (US)

( * ) Notice: Subject to any disclaimer, the term of this patent is extended or adjusted under 35 U.S.C. 154(b) by 0 days.

(21) Appl. No.: 16/929,363

(22) Filed: Jul. 15, 2020

(65) Prior Publication Data

US 2021/0015228 A1 Jan. 21, 2021

Related U.S. Application Data

(60) Provisional application No. 62/874,286, filed on Jul. 15, 2019.

(51) Int. Cl.
*A45C 11/08* (2006.01)
*A45F 3/14* (2006.01)

(52) U.S. Cl.
CPC ..... *A45C 11/08* (2013.01); *A45F 3/14* (2013.01); *A45F 2003/142* (2013.01)

(58) Field of Classification Search
CPC ..... A45C 11/08; A45F 3/14
USPC ..... 224/623, 909
See application file for complete search history.

(56) References Cited

U.S. PATENT DOCUMENTS 651,937 A * 6/1900 Short ..... B65D 33/30 383/905
3,402,052 A * 9/1968 Walker ..... B65D 33/30 383/905
4,051,994 A * 10/1977 Donk ..... B65D 33/30 383/905
4,232,808 A * 11/1980 Gray ..... A45C 11/38 224/616
4,865,191 A * 9/1989 Easter ..... A45C 11/08 206/316.3
4,898,280 A * 2/1990 Runge ..... B29C 66/4722 383/905
5,027,965 A * 7/1991 Dumars ..... B63B 25/082 114/211
5,320,261 A * 6/1994 Andersen ..... A45F 5/00 224/269

(Continued)

FOREIGN PATENT DOCUMENTS

GB 134403 A 11/1919

OTHER PUBLICATIONS

International Search Report and Written Opinion received for International Application No. PCT/US2020/042072, dated Oct. 30, 2020, 12 pages.

(Continued)

*Primary Examiner* — Nathan J Newhouse
*Assistant Examiner* — Lester L Vanterpool
(74) *Attorney, Agent, or Firm* — DORSEY & WHITNEY LLP

(57) ABSTRACT

A case for a portable hand-held devices, such as binoculars. The case assembly includes a main case portion having an opening defined by a periphery and a cover. A reconfigurable member is attached to at least a portion of the cover and can be configured to correspond to an outer profile of the hand-held device being stored within the case.

19 Claims, 9 Drawing Sheets

(56) References Cited

U.S. PATENT DOCUMENTS

| | | | | |
|---|---|---|---|---|
| 6,095,328 | A * | 8/2000 | Smithbaker, III | A45C 11/08 206/316.3 |
| 6,244,081 | B1 | 6/2001 | Schlipper | |
| 6,273,608 | B1 * | 8/2001 | Ward, Jr. | B65D 33/30 383/203 |
| 6,308,875 | B1 * | 10/2001 | Almo | A61B 50/20 224/660 |
| 7,036,943 | B1 * | 5/2006 | Brewer | G02B 23/18 359/511 |
| 7,059,503 | B2 * | 6/2006 | Andersen | A45F 3/14 224/648 |
| D601,341 | S | 10/2009 | Arman | |
| 7,665,895 | B2 * | 2/2010 | Takita | B65D 33/30 383/905 |
| 7,993,256 | B2 * | 8/2011 | Takita | B65D 33/30 383/88 |
| 8,132,669 | B1 * | 3/2012 | Stubel | A45C 11/08 206/316.3 |
| 8,720,681 | B1 * | 5/2014 | Hancock | A45C 13/1069 224/183 |
| 9,102,443 | B2 * | 8/2015 | Fisher | B65D 33/30 |
| 9,210,978 | B1 * | 12/2015 | Hunt | F16B 1/00 |
| 9,332,822 | B2 * | 5/2016 | Hunt | A45F 5/14 |
| 9,872,553 | B1 * | 1/2018 | Erlandson | A45F 3/00 |
| 2003/0029895 | A1 | 2/2003 | Andersen | |
| 2004/0140335 | A1 * | 7/2004 | Hancock | A45F 3/14 224/648 |
| 2006/0162830 | A1 | 7/2006 | Gerber et al. | |
| 2006/0285779 | A1 * | 12/2006 | Golas | B65D 33/1658 383/905 |
| 2009/0123092 | A1 * | 5/2009 | Rahamim | B65D 33/30 383/33 |
| 2014/0191008 | A1 * | 7/2014 | Zwetzig | A45C 11/38 224/607 |
| 2014/0254959 | A1 * | 9/2014 | Peck | A45C 7/0077 383/107 |
| 2017/0367451 | A1 | 12/2017 | Brin | |
| 2018/0255893 | A1 | 9/2018 | Godshaw et al. | |

OTHER PUBLICATIONS

"Binocular Harness System—KUIU Demonstration", YouTube video, posted Jul. 19, 2013, KUIU Ultralight Hunting, retrieved from https://www.youtube.com/watch?v=Zgt1LLTuRlo.

"KUIU PRO Bino Harness Overview", YouTube video, posted Jul. 23, 2019, KUIU Ultralight Hunting, retrieved from https://www.youtube.com/watch?v=I0QAMSyMRnk.

International Preliminary Report on Patentability issued in International Patent Application No. PCT/US2020/042072 dated Jan. 27, 2022, 7 pages.

Extended European Search Report dated Oct. 24, 2023 for EP Application No. 20841490.4.

* cited by examiner

RECONFIGURABLE CASES FOR PORTABLE HAND-HELD DEVICES AND METHODS

CROSS-REFERENCE TO RELATED APPLICATION

This application claims the benefit of U.S. Provisional Patent Application No. 62/874,286, entitled RECONFIGURABLE CASES FOR PORTABLE HAND-HELD DEVICES AND METHODS, filed on Jul. 15, 2019, the disclosure of which is incorporated by reference herein in its entirety.

TECHNICAL FIELD

The present disclosure generally relates to cases for hand-held devices, and more particularly to cases for carrying hand-held optical devices for immediate use.

BACKGROUND

One of the many utilities of a case relates to securing, supporting, or otherwise retaining devices such as hand-held optical devices, including without limitation binoculars and cameras, within the case during transport and use. Some cases are specifically designed to transport a particular device or particular type of device. Designing a case to secure or support a particular device or type of device, however, can be problematic. For example, portable hand-held optical devices, such as binoculars and cameras have a wide variety of shapes, profiles, and sizes Such devices have a tendency to move while in the case and, depending on the activity in which the user is involved, may jostle and make noise within the case, and perhaps even fall out of the case. There is a need to provide a carrying case for hand-held optical devices that can be custom configured to better retain, support, and secure such devices while being worn by a user of the devices.

SUMMARY

One aspect of the present disclosure relates to a cover apparatus for carrying and protecting portable hand-held optical devices. The apparatus can include a lower portion having an opening, at least one wall, a base, and a reconfigurable member. The opening can include a periphery defined by the at least one wall. The base can be coupled to the at least one wall. The base and the at least one wall can define a volume within the lower portion. The reconfigurable member can be coupled to the at least one wall and extend around at least a portion of the periphery of the opening. The reconfigurable member can be configured to conform to a portion of an outer profile of a device positioned within the lower portion.

The apparatus can further include a second reconfigurable member configured to conform to a second portion of the outer profile of the device positioned within the lower portion. The reconfigurable member can extend around an entirety of the periphery. The reconfigurable member can be made of metal. The reconfigurable member can be positioned between an upper edge of the at least one wall and the base. The reconfigurable member can be positioned on an upper edge of the at least one wall. The lower portion can also include at least one strap configured to couple the lower portion to an over-shoulder harness. The apparatus can also include an upper portion. The upper portion can be operably coupled to the lower portion and configured to render the opening of the lower portion accessible in a first state and transition to cover the opening in a second state.

Another aspect of the present disclosure relates to a cover apparatus for carrying and protecting portable optics. The apparatus can include an over-shoulder harness and a case assembly. The case assembly can include a lower portion and an upper portion. The lower portion can have at least one strap configured to couple the over-shoulder harness to the lower portion. The lower portion can further include an opening and at least one wall having an upper edge. The upper edge of the at least one wall can define the opening. The lower portion can also include a base coupled to the at least one wall. The base and the at least one wall can define a volume within the lower portion. The lower portion can also include a reconfigurable member coupled to the at least one wall. The reconfigurable member can extend around the upper edge of the at least one wall. The reconfigurable member can be conformable to an outer profile of a device positioned within the lower portion. The upper portion can be operably coupled to the lower portion and configured to render the opening of the lower portion accessible in a first state and transition to cover the opening in a second state.

In some configurations, a portion of the device positioned within the lower portion can extend through the opening of the lower portion. The upper portion can be operably coupled to the at least one wall. The reconfigurable member can be positioned between the upper edge of the at least one wall and a sleeve positioned on a portion of the upper edge. The sleeve can form an elongate channel or aperture which receives at least a portion of the reconfigurable member. The opening can define a first plane. The base of the lower portion can define a second plane. The first plane can be oblique to the second plane. The reconfigurable member can be conformable to a pair of binoculars. The reconfigurable member can be an elongate portion of metal.

Yet another aspect of the present disclosure relates to a method for carrying and protecting portable optics within a case. The method can include exposing an opening within a lower portion of the case by transitioning an upper portion of the case away from the opening. The method can further include placing a device at least partially within an inner volume defined by the lower portion of the case. The method can also include forming a reconfigurable member to approximate at least a portion of an outer profile of the device within the case.

The method can also include forming a second reconfigurable member to approximate another portion of the outer profile of the device within the case. The method can also include repositioning the upper portion of the case to at least partially cover the opening within the lower portion of the case. The reconfigurable member can be curved or bent to approximate the portion of the outer profile of the device positioned within the case.

The above summary of the present invention is not intended to describe each configuration or every implementation of the present invention. The Figures and the detailed description that follow more particularly exemplify one or more configurations.

BRIEF DESCRIPTION OF THE DRAWINGS

The accompanying drawings and figures illustrate a number of exemplary configurations and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
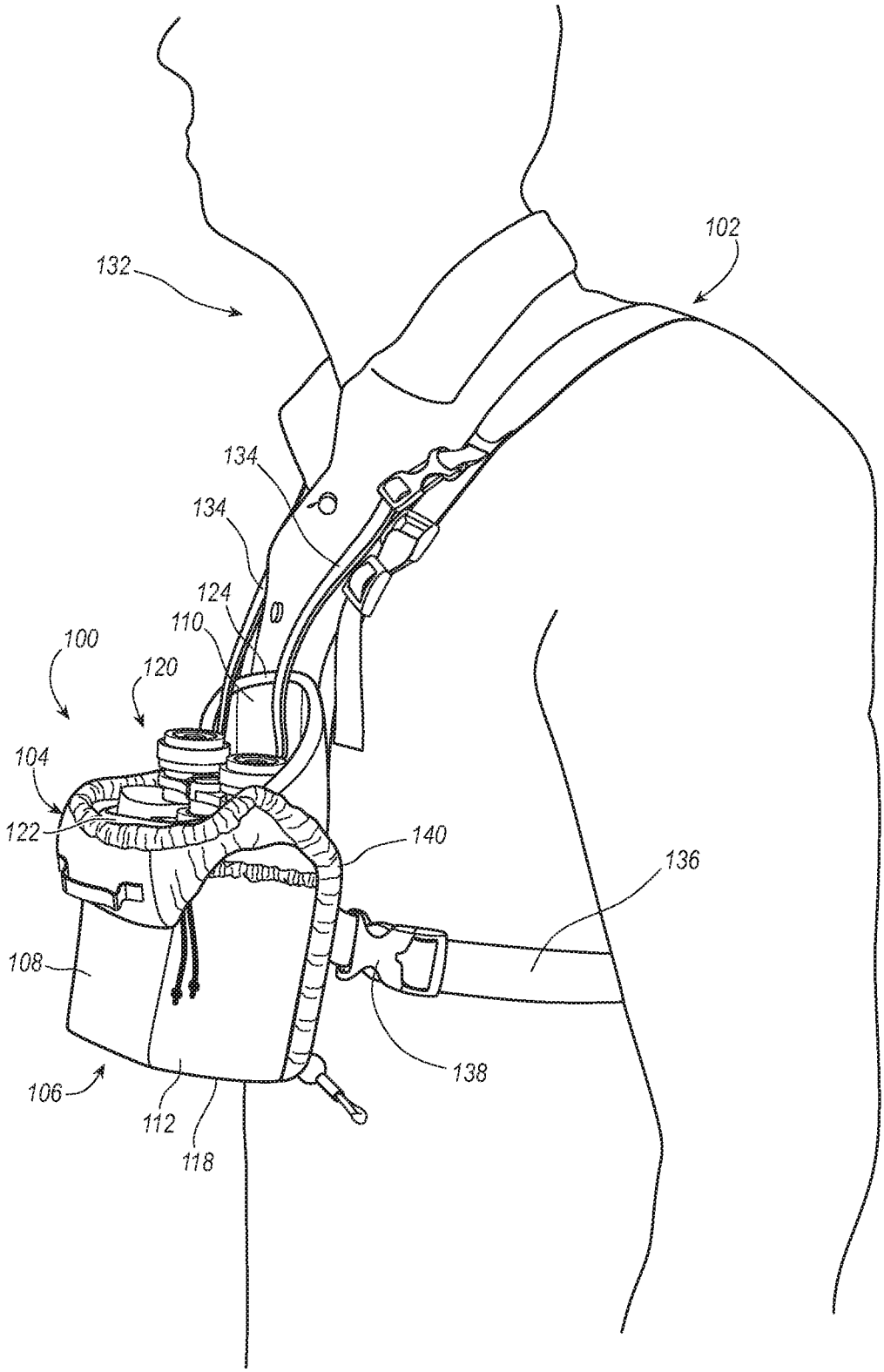
FIG. 1 is a perspective view of a case assembly with an over-shoulder harness.

While the configurations described herein are susceptible to various modifications and alternative forms, specific configurations have been shown by way of example in the drawings and will be described in detail herein. However, the exemplary configurations described herein are not intended to be limited to the particular forms disclosed. Rather, the instant disclosure covers all modifications, equivalents, and alternatives falling within the scope of the appended claims.

DETAILED DESCRIPTION

The present disclosure generally relates to cases, and to supporting and retaining devices within a case. More specifically, the present disclosure relates to a case assembly having at least one reconfigurable member which is conformable to approximate an outer profile of a device within the case to better retain and support the device within the case. For example, an opening within the case can be reconfigured via a reconfigurable member to approximate the outer profile of an optical device (e.g., binoculars, camera, etc.) and thereby secure the optical device within the case.

The present description provides examples, and is not limiting of the scope, applicability, or configuration set forth in the claims. Thus, it will be understood that changes may be made in the function and arrangement of elements discussed without departing from the spirit and scope of the disclosure, and various configurations may omit, substitute, or add other procedures or components as appropriate. For instance, the methods described may be performed in an order different from that described, and various steps may be added, omitted, or combined. Also, features described with respect to certain configurations may be combined in other configurations.

FIG. 1 shows a perspective view of a case assembly 100 with an over-shoulder harness 102. The case assembly 100 includes an upper portion 104 and a lower portion 106. The lower portion 106 can include one or more walls 108, 110, 112, 114 which define a cavity or volume 116 within the case assembly 100. In some configurations, a single wall can extend continuously around a base 118 to form the lower portion 106. In another configuration, as depicted in FIGS. 1 and 2, distinct walls (e.g., front wall 108, rear wall 110, and side walls 112, 114) can be operably coupled to the base 118 to form the lower portion 106. The front wall 108 can be positioned forward relative to the cavity or volume 116 of the case assembly 104. Similarly, the side walls 112, 114 and the rear wall 110 can be respectively positioned relative to the cavity or volume 116 of the case assembly 100 (i.e., the rear wall 110 can be positioned behind the cavity 116 and the side walls 112, 114 can be position on respective sides of the cavity 116). The base 118 can be a floor or bottom layer of material of the lower portion 106 which supports a device 120 (e.g., a camera, binoculars, etc.) stored within the cavity or volume 116.

The cavity or volume 116 within the case assembly 100 is operable to carry, store, secure, or otherwise protect one or more portable hand-held devices or other types of devices 120 (e.g., binoculars, camera, rangefinder, etc.). The one or more walls of the lower portion 106 can include respective upper edges 122, 124, 126, 128 which define an opening 130 within the case assembly 100, wherein one or more devices can be positioned within the cavity or volume 116 via the opening 130. In some configurations, the upper portion 104 can be configured to transition relative to the lower portion 106 such that the opening 130 of the lower portion 106 can be covered or concealed by the upper portion 104 (see FIG. 2B) to retain the device 120 (e.g., binoculars) within the cavity or volume 116 of the lower portion 106. For example, a pair of binoculars 120 can be at least partially retained within the cavity or volume 116 of the lower portion 106. As depicted in FIG. 1, the case assembly 100 can be configured to retain a pair of binoculars 120 in an upright position near a torso of the wearer 132 within the case assembly 100.

In some configurations, an adjustable strap 134 of the over-shoulder harness 102 can be operably coupled directly to the device being retained within the case assembly 100. For example, the adjustable strap 134 can be operably coupled to device 120 using clips, buckles, rings, fasteners or another method of attachment. In some configurations, the over-shoulder harness 102 can be operably coupled to the case assembly 100 itself. For example, the over-shoulder harness 102 can be operably coupled to the lower portion 106 of the case assembly 100 via one or more adjustable straps 136. The one or more adjustable straps 136 can utilize one or more adjustment mechanisms 138 (e.g., releasable clips, buckles, etc.) which allow the wearer 132 to easily and quickly adjust, secure, or remove the over-shoulder harness 102 from the case assembly 100. In some configurations, the over-shoulder harness 102 can be adjustable to accommodate a plurality of torso sizes. A person having ordinary skill in the art will appreciate that although an over-shoulder harness 102 is depicted and described herein, any harness or attachment system (e.g., a belt, a single shoulder strap, etc.) can be used to retain the case assembly 100 to the wearer 132.

Figure 2A:
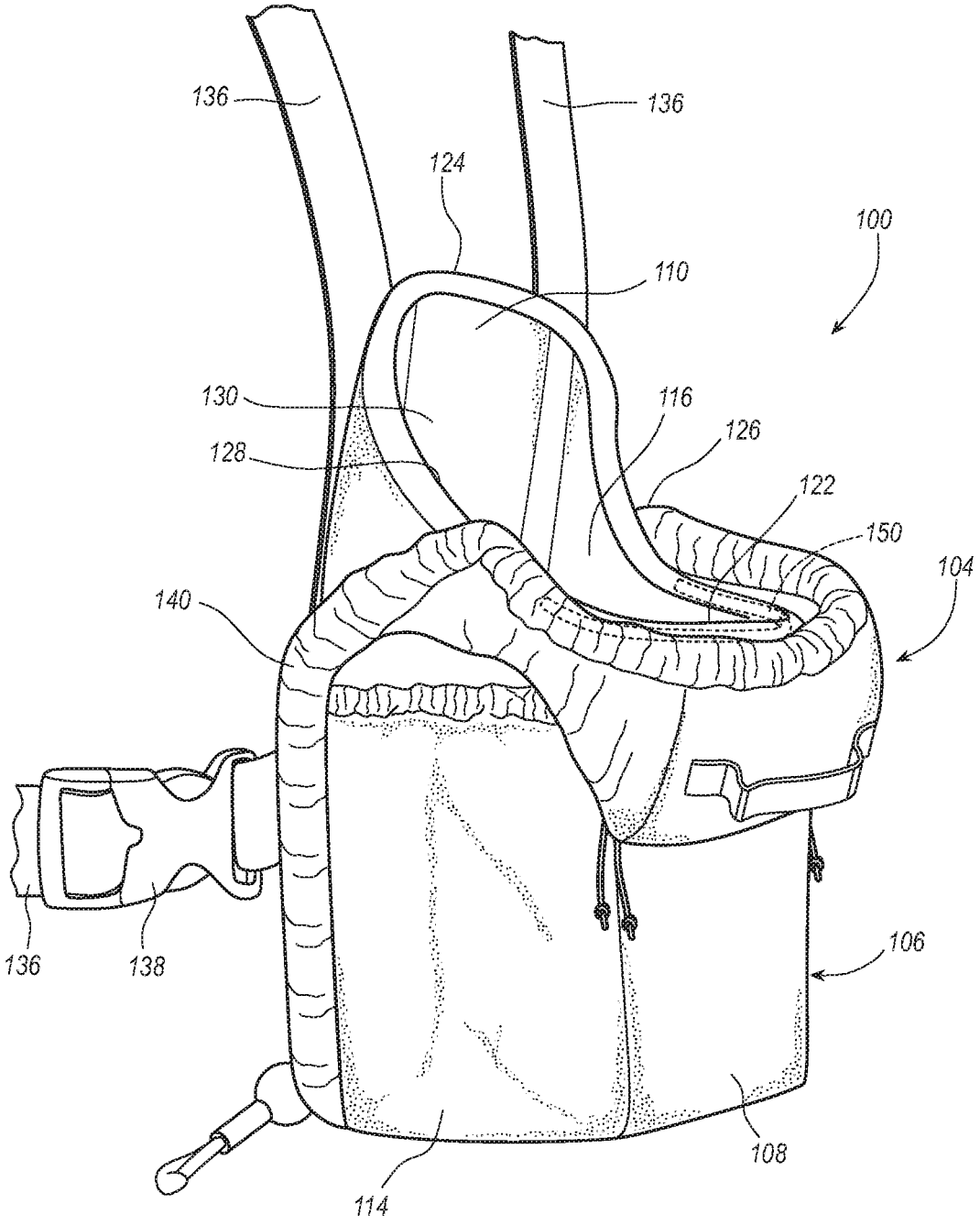
FIG. 2A is a front-side perspective view of a case assembly having an uncovered or open lower portion according to the present disclosure.

FIG. 2A shows a front-side perspective view of a case assembly 100 having an uncovered or open lower portion 106 according to the present disclosure. In some configurations, the upper portion 104 can transition to at least partially reveal the opening 130 and at least partially cover the front wall 108 of the lower portion 106 (i.e., a first state of the upper portion 104). While in the first state, the upper portion 104 can render the opening 130 of the lower portion 106 accessible, such that a user can insert and remove devices from the cavity or volume 116. The upper portion 104 can be operably coupled to the rear wall 110 of the lower portion 106 by one or more straps 140. The straps 140 can be elastically deformable or otherwise configured to stretch or bend to allow the upper portion 104 to move relative to the lower portion 106. The straps 140 can be incorporated into one or more of the side walls 112, 114 of the lower portion 106.

Figure 2B:
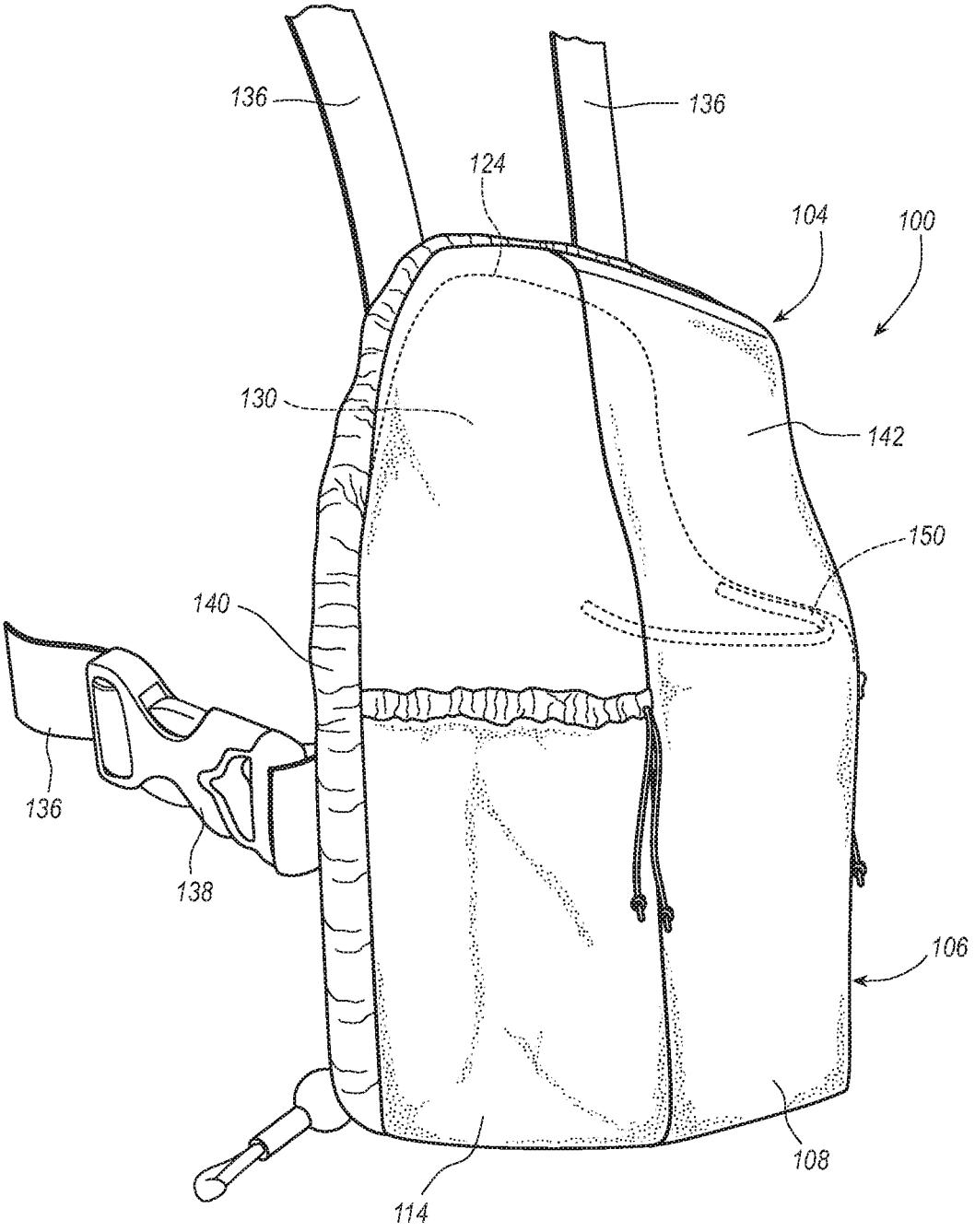
FIG. 2B is a front-side perspective view of a case assembly having a covered or closed lower portion according to the present disclosure.

FIG. 2B shows a front-side perspective view of the case assembly 100 having a covered or closed lower portion 106 according to the present disclosure. In some configurations, the upper portion 104 can transition to at least partially cover the opening 130 to retain or secure one or more devices 120 (e.g., binoculars) within the lower portion 106 (i.e., a second state of the upper portion 104). As depicted in FIG. 2B, the upper portion 104 can be positioned to cover an entirety of the opening 130 and thereby cover, secure, and/or protect a portion of a device 120 (e.g., binoculars) placed within the case assembly 100. In some configurations, the upper portion 104 can be operably coupled to the front wall 108 of the lower portion 106. For example, as depicted in FIG. 2B, the front wall 108 of the lower portion 106 and the upper portion 104 are formed using a single structure or unitary type of material. In other words, a portion (e.g., a layer of material 142) of the front wall 108 can extend upward and away from the base 118 to form all or a portion the upper portion 104. Similarly, as depicted in FIG. 2A, the side walls 112, 114 of the lower portion 106 can extend upward and away from the base 118 to form all or a portion the upper portion 104. In some configurations, the upper portion 104 can overlay or cover a portion of the rear wall 110 while the upper portion 104 is in the second state (i.e., covering the opening 130). For example, the upper portion 104 can cover an upper edge 124 of the rear wall 110.

Figure 3:
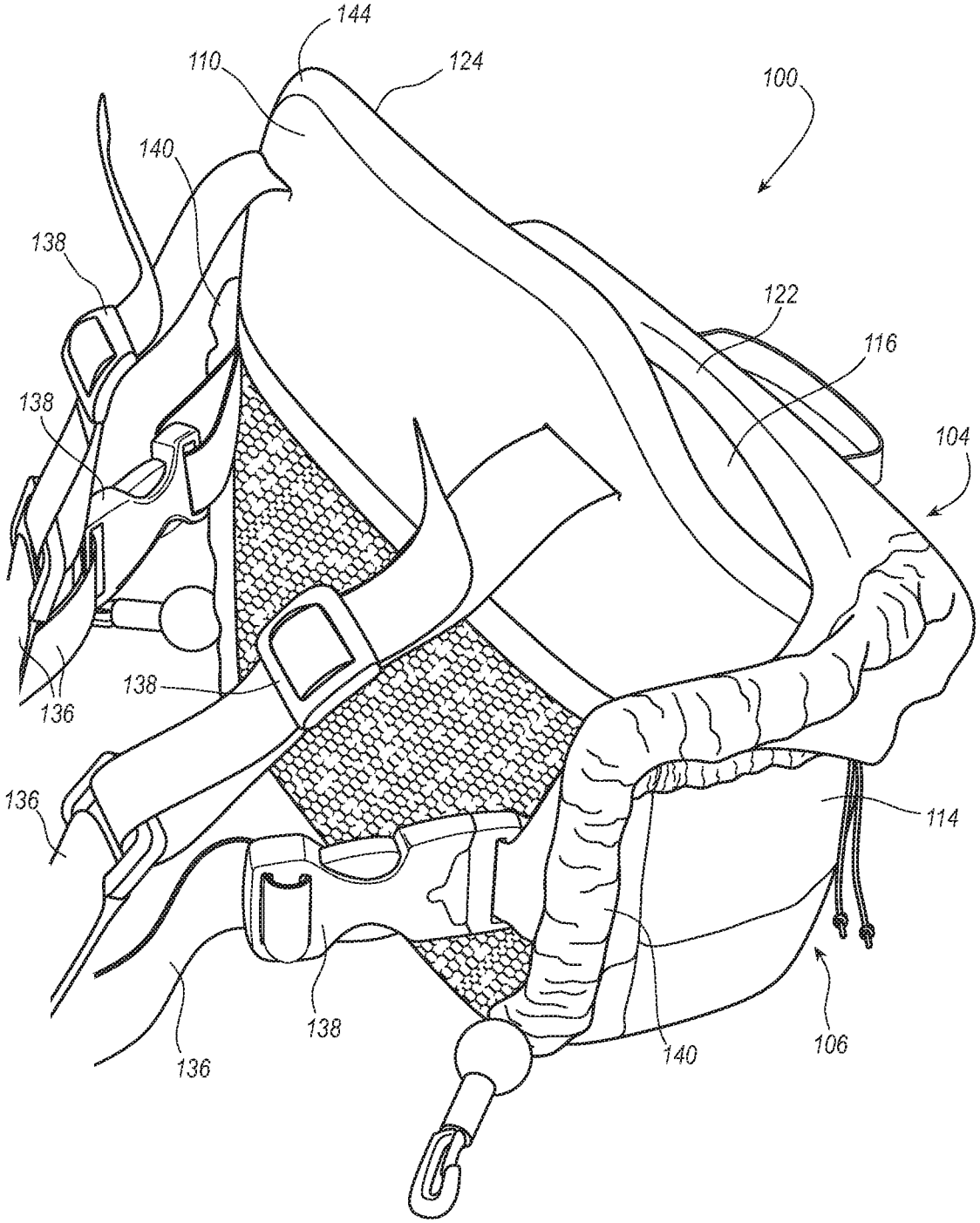
FIG. 3 is a rear-side perspective view of case assembly shown in FIG. 2A, illustrating straps which operably couple an over-shoulder harness to the lower portion.

FIG. 3 is a rear-side perspective view of the case assembly 100 shown in FIG. 2A, illustrating multiple straps 136 which operably couple the over-shoulder harness 102 to the lower portion 106. In some configurations, one or more of the straps 136 can be operably coupled to the rear wall 110. Additionally or alternatively, one or more of the straps 136 can be operably coupled to one or more of the side walls 112, 114. Each of the multiple straps 136 can include one or more adjustment mechanisms 138 (e.g., buckles, clips, etc.) configured to adjust the length and/or position of the straps 136 relative to the wearer 132.

In some configurations, the rear wall 110 of the lower portion 106 can extend a first distance from the base 118 while the front wall 108 extends a second distance from the base 118. In configurations wherein the first and second distances are unequal, the opening 130 and its associated periphery can be nonparallel to the base 118 of the lower portion 106. Meaning, a plane defined by the opening 130 is oblique to the rear wall 110, the front wall 108, and the base 118 of the lower portion 106. In some configurations, the first distance or height of the rear wall 110 can be greater than the second distance or height of the front wall 108 relative to the base 118.

Figure 4:
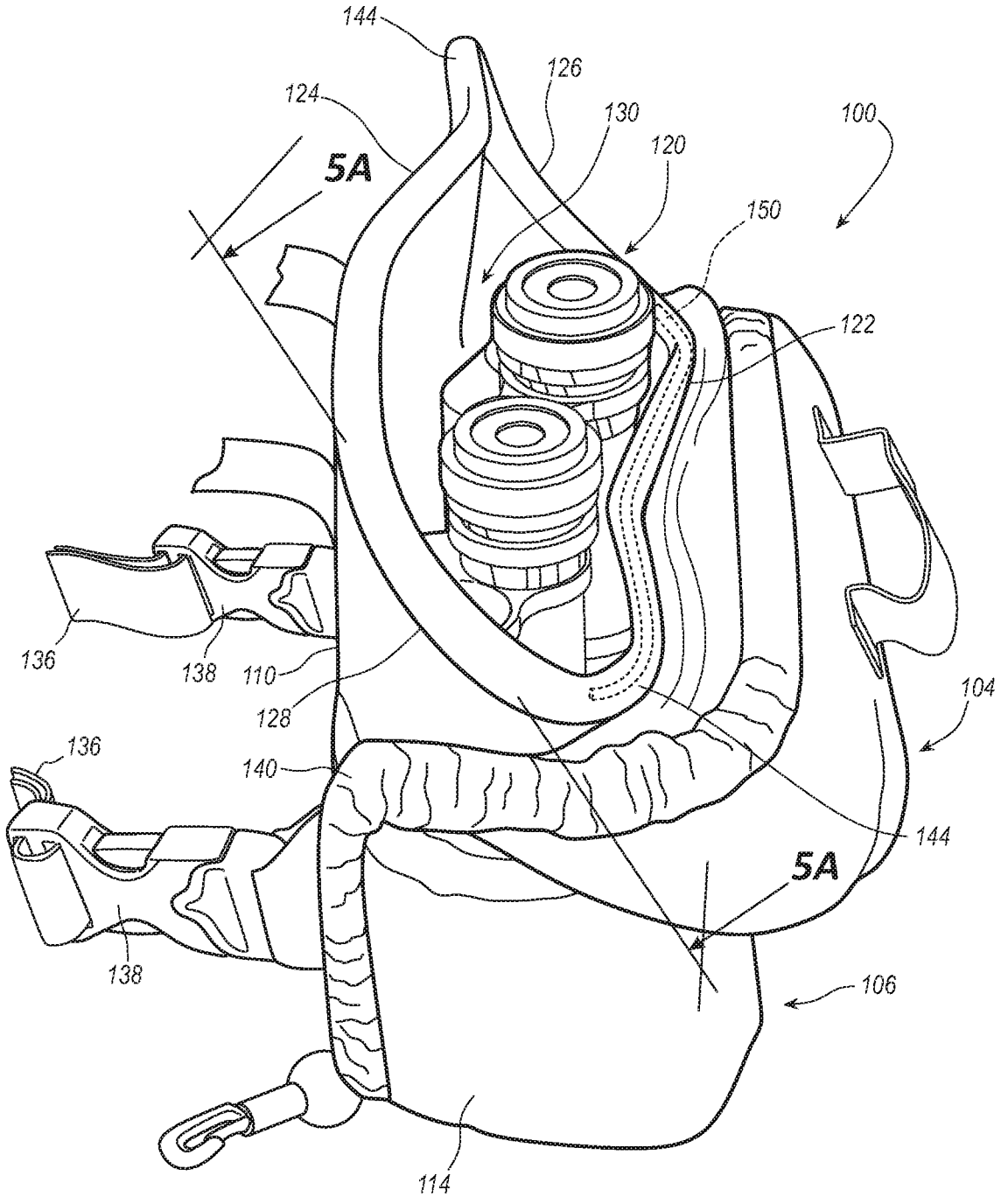
FIG. 4 is an elevated side prospective view of the case assembly depicted in FIG. 2A, illustrating a single reconfigurable member of the case assembly.

FIG. 4 shows an elevated side prospective view of the case assembly 100 depicted in FIG. 2A, illustrating an elongated reconfigurable, bendable, malleable member 150 positioned around a portion of the periphery of the lower portion 106 of the case100. The reconfigurable member 150 can be positioned on or within one or more of the upper edges 122, 124, 126, 128 of their respective walls 108, 110, 112, 114 and can extend around a portion of the periphery, a majority of the periphery, or an entire periphery of the opening 130. For example, as depicted in FIGS. 2A, 2B, and 4, the reconfigurable member 150 can be positioned on or within the upper edge 122 of the front wall 108. The reconfigurable member 150 can run along or extend generally parallel to the upper edges 122, 124, 126, 128. In some configurations, the reconfigurable member 150 can be attached, adhered, or otherwise coupled to the upper edges 122, 124, 126, 128 of their respective walls 108, 110, 112, 114. Additionally or alternatively, the reconfigurable member 150 can be configured to be insertable within one or more sleeves, channels, apertures or other elongate retaining features positioned within or on the walls 108, 110, 112, 114, such that the reconfigurable member 150 is effectively housed within one or more of the walls 108, 110, 112, 114. For example, a sleeve 144 can be sewn or otherwise attached to the upper edges 122, 124 of the front wall 108 and rear wall 110, respectively. The sleeve 144 can be configured to receive a portion or the entirety of the reconfigurable member 150 and thereby secure the reconfigurable member 150 to one or more of the walls 108, 110, 112, 114. In some configurations, the reconfigurable member 150 can be positioned within one or more of the walls 108, 110, 112, 114 of the lower portion 106 (see FIGS. 6 and 7). In some configurations, the reconfigurable member 150 can be coupled to a surface of the one or more of the walls 108, 110, 112, 114 of the lower portion 106.

The reconfigurable member 150 can be reconfigured, shaped, reshaped, molded, formed, bent or otherwise manipulated relative to its original linear longitudinal axis to retain a curved, bent, angled, or nonlinear shape. The reconfigurable member 150 can be bent such that a length of the reconfigurable member 150 replicates or approximates at least a portion of the outer profile of the device being held within the lower portion 106 of the case 100. For example, the reconfigurable member 150 can be bent or shaped to approximate a portion of an outer profile of the device 120 stored within the lower portion 106 as depicted in FIGS. 4 and 5. The reconfigurable member 150 can be reshaped or reconfigured, even repeatedly, to alter at least a portion of the periphery of the opening 130. Thus, at least a portion of the upper edges 122, 124, 126, 128 of the walls 108, 110, 112, 114 can be configured to correspond to the outer profile or periphery of a hand-held, portable device (which can be of varying sizes, shapes, and outer profiles) to hold the device more securely within the case.

In some configurations, multiple reconfigurable members 150 (only one shown in FIGS. 2A and 2B) and be used, and can be positioned between the upper edges 122, 124, 126, 128 and the base 118 of the lower portion 106. In other words, the reconfigurable member 150 can be coupled to one or more of the walls 108, 110, 112, 114 at an intermediate position located between the base 118 and the periphery of the opening 130. By positioning the reconfigurable member 150 at an intermediate position located between the base 118 and the periphery of the opening 130, a device stored within the case assembly 100 can be supported in a particular orientation relative to the walls 108, 110, 112, 114 of the case assembly 100. For example, the reconfigurable member 150 can directly or indirectly contact the device 120 within the lower portion 106 and thereby minimize movement of the device 120 (e.g., back-and-forth movement, jostling, rotating, or other movement) relative to the walls 108, 110, 112, 114 of the lower portion 106.

The reconfigurable member 150 can be manufactured or otherwise formed using one or more materials which can be manipulated to vary in shape and thereafter retain the manipulated shape. For example, the reconfigurable member 150 can be an elongate metallic structure (e.g., a rounded or flattened metal wire) which is semi-rigid (i.e., deformable yet capable of retaining a deformation). In some configurations, the reconfigurable member 150 can be configured as a continuous circular or oval ring which extends around the periphery of the opening 130. Additionally or alternatively, the reconfigurable member 150 can include a plurality of distinct elongate structures positioned around the periphery of the opening 130 (see FIGS. 6 and 7).

In some configurations, the length of the reconfigurable member 150 can extend around an entire outer-perimeter or periphery of the opening 130. In other configurations, the length of the reconfigurable member 150 can be less than the outer-diameter of the opening 130. For example, the reconfigurable member 150 may only extend along the upper edge 122 of the front wall 108 in some configurations. In some configurations, a cross-section of the reconfigurable member can resemble a square, oval, circle, rectangle, hexagon, or any other geometric shape. For example, the reconfigurable member 150 can be formed of an elongate piece of metal having a cross-section which resembles a rectangle.

The reconfigurable member 150 can incorporate a plurality of gauges, thicknesses, or diameters to effectively vary the force required to bend the reconfigurable member 150 into a desired orientation. For example, the diameter of the reconfigurable member 150 can be greater than 0.1 mm. In some configurations, the diameter of the reconfigurable member 150 can be within a range of 0.1 mm to 1 mm. In other configurations, the diameter of the reconfigurable member 150 can be within a range of 1 mm to 3 mm. In yet other configurations, the diameter of the reconfigurable member 150 can be within a range of 3 mm to 10 mm. In some configurations, the diameter of the reconfigurable member 150 can be less than 10 mm.

Any of the above-mentioned aspects of the reconfigurable member 150 (e.g., length, gauge, thickness, diameter, cross-sectional shape, etc.) can also vary along the length of the reconfigurable member 150. For example, the diameter or gauge of the reconfigurable member 150 at a center section of the reconfigurable member 150 can be greater than or less than the diameter or gauge of the reconfigurable member 150 at an end section of the reconfigurable member 150.

Figure 5A:
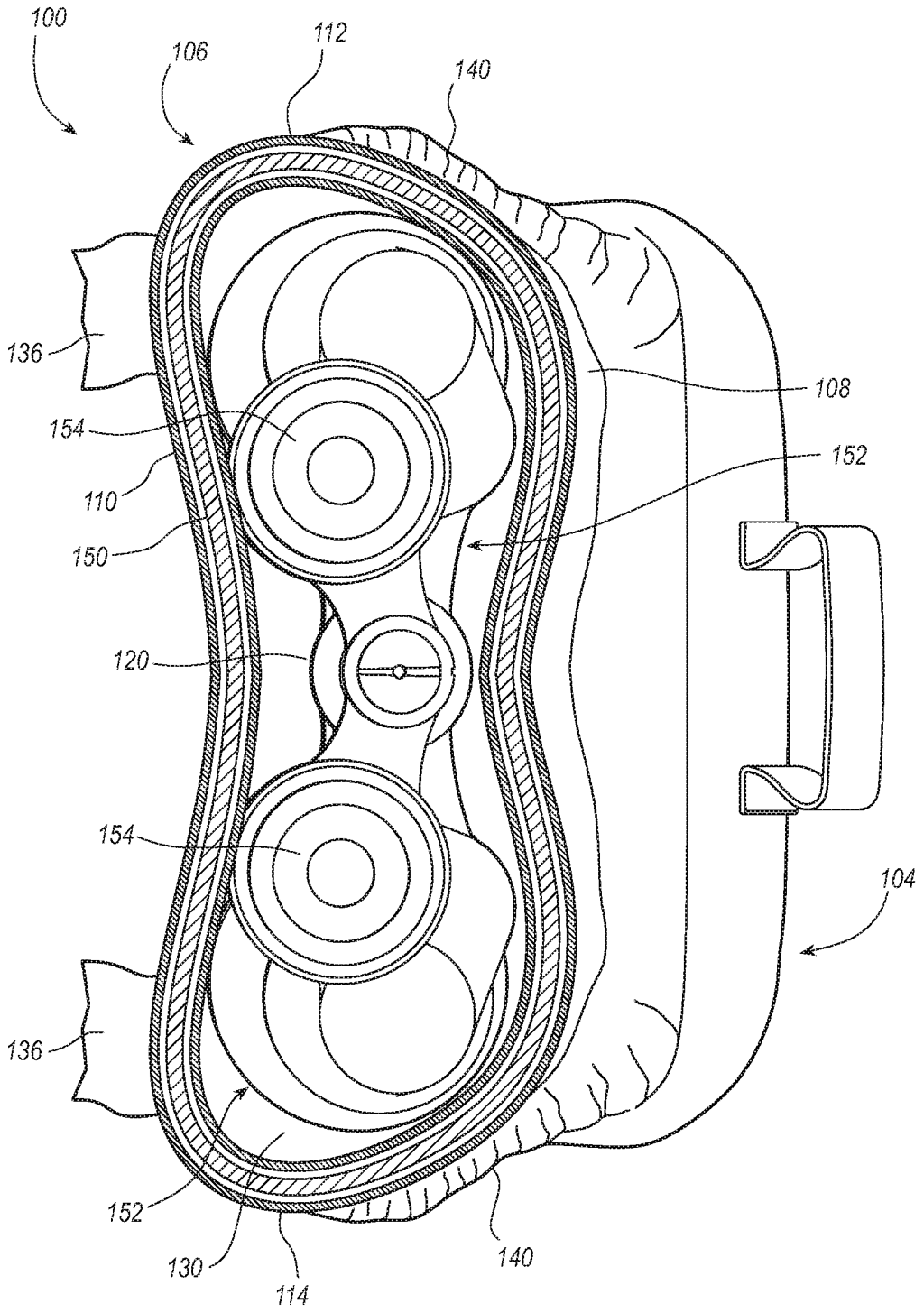
FIG. 5A is a cross-section view taken through the line 5-5 shown in FIG. 4 after the reconfigurable member has been formed to approximate an outer profile of a pair of binoculars.
Figure 5B:
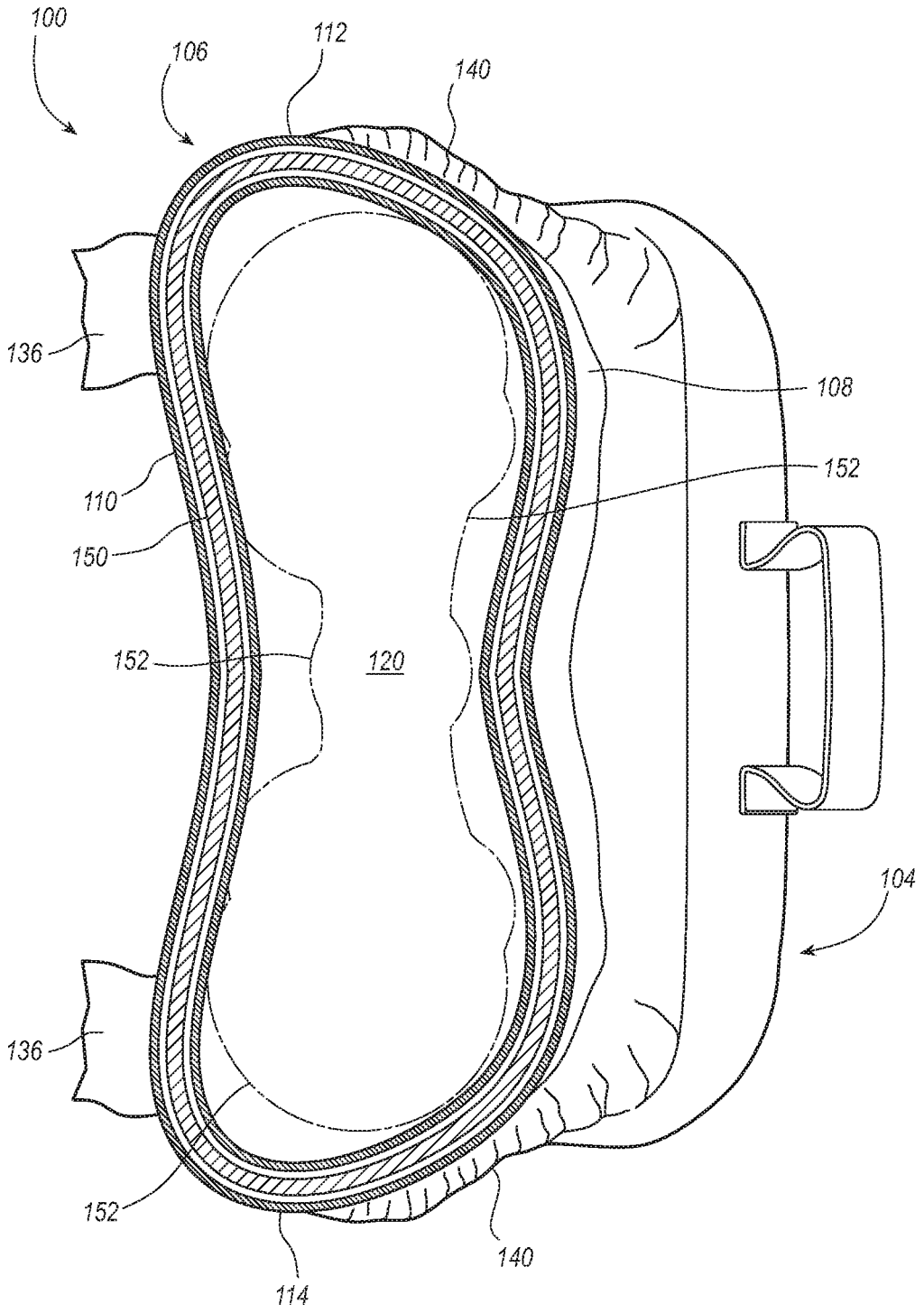
FIG. 5B is a cross-section view taken through the line 5-5 shown in FIG. 4 illustrating the reconfigurable member relative to the outer profile of a pair of binoculars.
Figure 6:
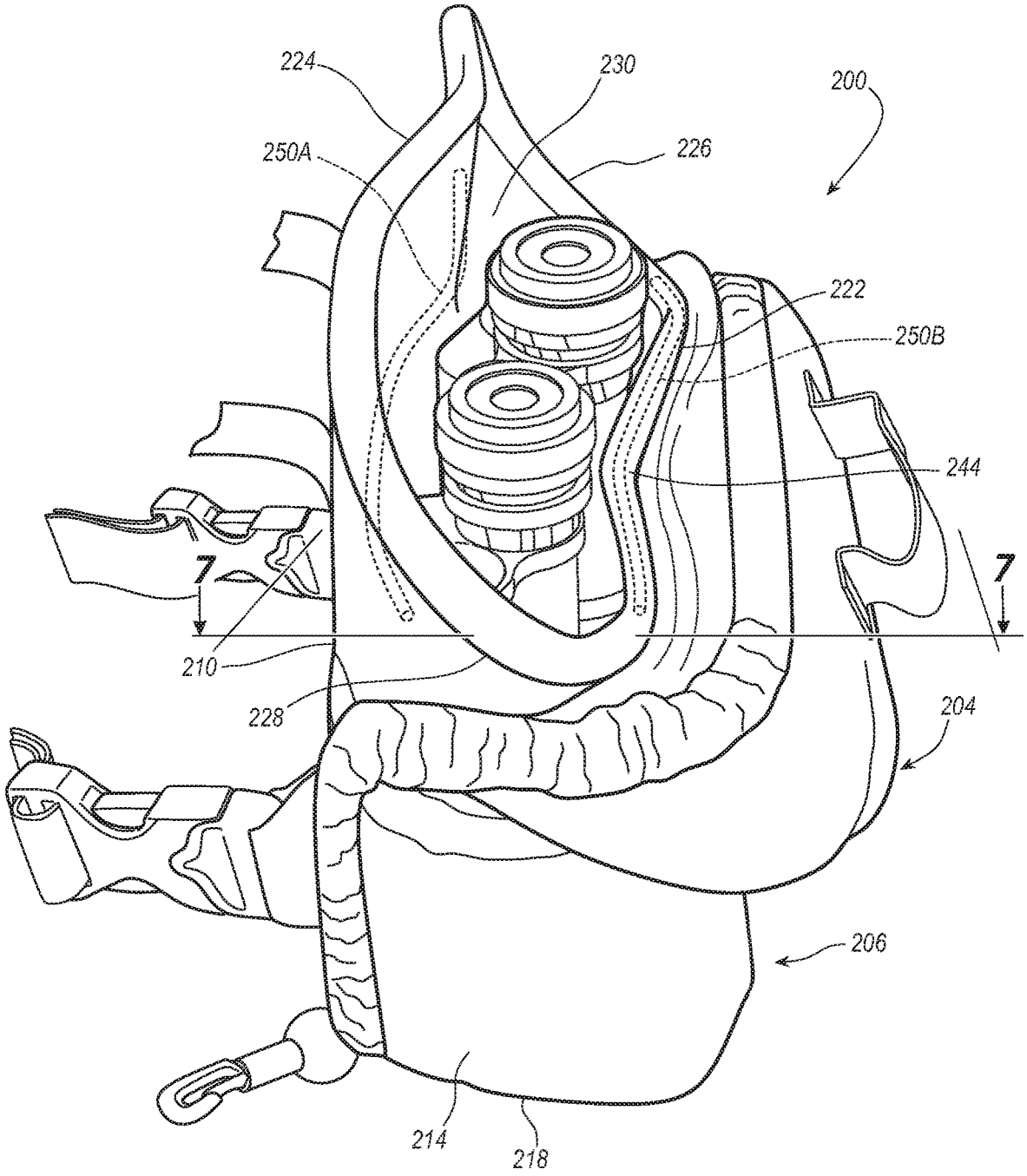
FIG. 6 is an elevated front-side prospective view of an configuration of a case assembly, illustrating multiple reconfigurable members of the case assembly.
Figure 7:
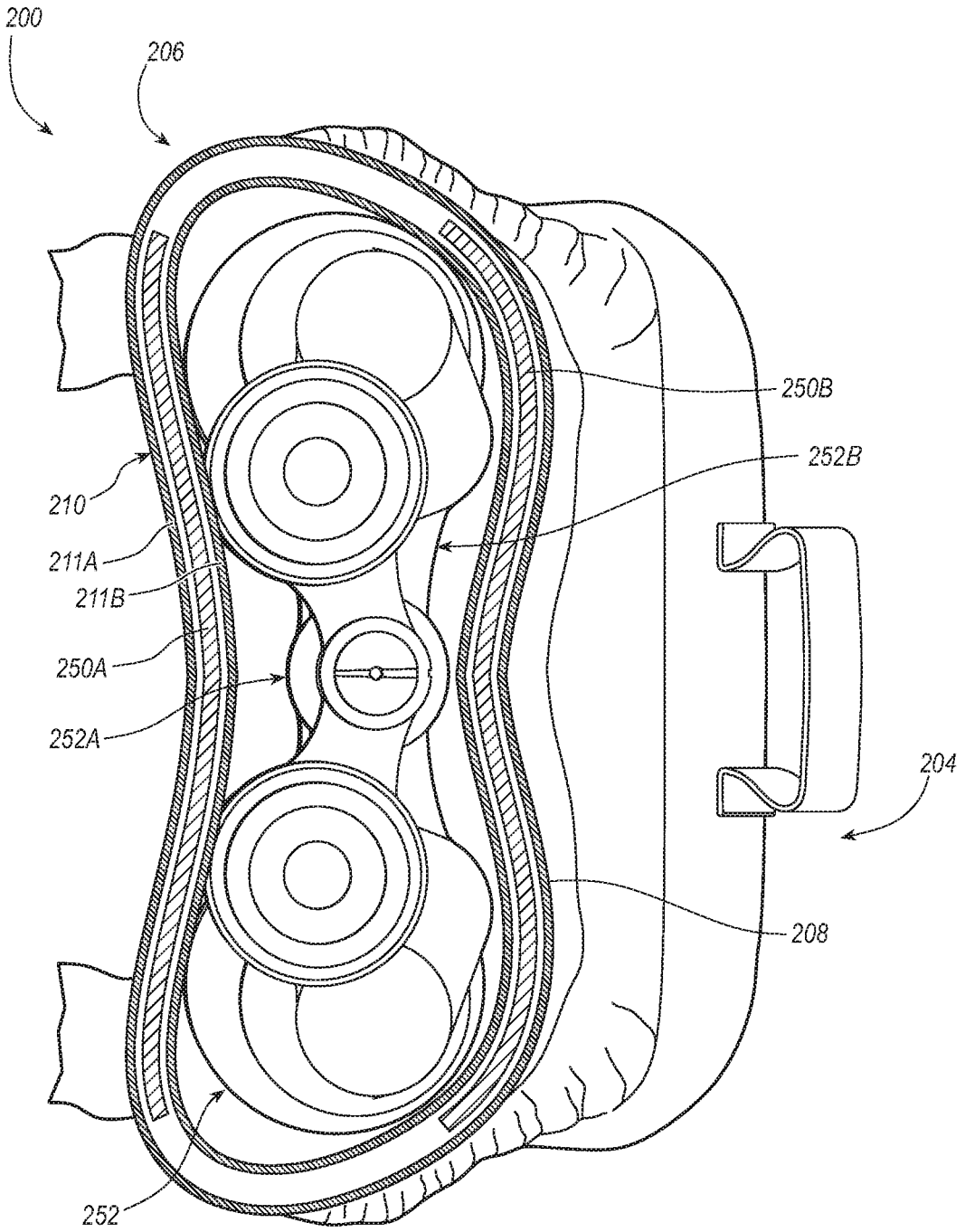
FIG. 7 is a cross-section view taken through the line 7-7 shown in FIG. 6 after the multiple reconfigurable members have been formed to approximate outer profiles of a pair of binoculars.

FIG. 5A shows a cross-section view taken through the line 5-5 shown in FIG. 4 wherein the reconfigurable member 150 is formed to approximate an outer profile 152 of a pair of the device 120 and thereby retain the opening 130 in shape that approximates the outer profile 152. As shown in FIGS. 5A and 5B, the periphery of the opening 130 has been manipulated by the reconfigurable member 150 to approximate an outer profile 152 of the device 120. The reconfigurable member 150 can span a first portion of the periphery (as shown in FIGS. 2A, 2B, and 4). In some configurations, the reconfigurable member 150 can span a first and second portion of the outer periphery (as shown in FIGS. 6 and 7). In some configurations, the reconfigurable member 150 can span an entirety or substantial entirety of the outer periphery (as shown in FIGS. 5A and 5B). It should be appreciated that one or more reconfigurable members can be positioned at any location on the lower portion which would effectuate the aspects of the present disclosure described herein.

Manipulating the opening 130 to approximate the outer profile 152 of the device 120 can be useful to the wearer 132. In the event that the wearer does not first close or cover the case, the reconfigurable member 150 better retains and supports optics within the case assembly 100 and may prevent the optics from falling from the case assembly 100 and sustaining damage. For example, if a person 132 wearing the case assembly 100 bends over to retrieve a fallen device from the ground or crouches to avoid being seen by an animal, the wearer's optics may fall out of the case and potentially sustain damage. As a related example, outdoorsman (e.g., hunters, backpackers, wildlife photographers, etc.) often need to move in a crouched position while stalking or moving toward an animal (e.g., deer, elk, sheep, etc.). In this example the reconfigurable member 150 also helps to retain optics within the hunter's case while the outdoorsman is crouching or moves in a crouched position. As yet another example, a hunter's success is often predicated on remaining unseen and unheard. Accordingly, hunters do not want to repeatedly open and close their case to retrieve their optics (e.g., binoculars, range-finder, camera, etc.) because such action can generate unwanted movement and/or noise. Thus, the retaining member 150 can assist in retaining the outdoorsman's optics without requiring the hunter to repeatedly open and close the upper portion of the case when retrieving or storing their optics.

FIG. 5B shows a cross-section view taken through the line 5-5 shown in FIG. 4 illustrating the position of the reconfigurable member 150 relative to the outer profile 152 of the device 120. After positioning the device 120 within the case assembly 100, a wearer 132 can squeeze, move, bend, or otherwise reposition the reconfigurable member 150 to approximate the outer profile 152 of the device 120 to better retain the device 120 within the case assembly 100. If the wearer 132 wishes to place a different pair of binoculars in the case assembly 100 (i.e., binoculars that differ in size or shape), the reconfigurable member 150 can be bent to increase the footprint or area of the opening 130. Thereafter, the wearer 132 can insert the alternative binoculars and squeeze, move, bend, or otherwise reposition the reconfigurable member 150 to approximate the outer profile 152 of the alternative binoculars.

It should be appreciated that the outer profile 152 of the device 120 can vary depending on the size, make, model, or manufacturer of the device 120. Thus, one aspect of the present disclosure is a reconfigurable member 150 which is operable to vary or alter the case assembly 100 to better retain optics of varying sizes and shapes. Yet another aspect of the present disclosure relates to a reconfigurable member 150 which is operable to vary or alter the case assembly 100 to better retain binoculars which have been adjusted to correspond to attributes of the wearer 132. For example, the wearer 132 can adjust the device 120, such as binoculars, such that eye pieces 154 of the device 120 align with the wearer's eyes (i.e., the wearer 132 adjusts the distance between the eye pieces 154 to coincide with the distance between the wearer's eyes). After making the adjustment, the wearer 132 can subsequently squeeze, move, bend, or otherwise reposition the reconfigurable member 150 to approximate the altered or adjusted outer profile 152 of the device 120.

FIG. 6 shows an elevated front-side prospective view of a case assembly 200, illustrating multiple reconfigurable members 250A, 250B positioned on respective walls 208, 210 of the lower portion 206. In some configurations, one or more reconfigurable members 250A, 250B can be positioned on one or more of the upper edges 222, 224, 226, 228 of the walls 208, 210, 212, 214 (i.e., around a periphery of the opening 230). For example, as depicted in FIGS. 6 and 7, a first reconfigurable member 250A can be coupled to the rear wall 210 between the upper edge 224 and a base 218 of the lower portion 206. A second reconfigurable member 250B can be positioned on and coupled to the upper edge 222 of the front wall 208. The first reconfigurable member 250A can extend along a portion of the rear wall 210 located between the upper edge 224 and the base 218. For example, the first reconfigurable member 250A can extend horizontally (i.e., parallel to the base 218) along the rear wall 210 at a distance from the base 118 which vertically aligns the first and second reconfigurable members 250A, 250B relative to the base 218. In other words, each of the first and second reconfigurable members 250A, 250B can be equally vertically spaced from the base 218. The second reconfigurable members 250B can span a distance along the upper edge 222 of the front wall 208.

In other configurations, a single reconfigurable member can be positioned on the upper edge 224 of the rear wall 210 or the upper edge 222 of the front wall 208. Alternatively or additionally, a single reconfigurable member can be positioned on the rear wall 210 between the upper edge 224 and the base 118. Similarly, a single reconfigurable member can be positioned on the front wall 208 between the upper edge 222 and the base 118. In some configurations, multiple reconfigurable members can be vertically or horizontally spaced from one another and positioned on the same wall (e.g., walls 208, 210, 212, 214).

FIG. 7 shows a cross-section view taken through the line 7-7 shown in FIG. 6 wherein the multiple reconfigurable members 250A, 250B are formed to approximate a first outer profile 252A and a second outer profile 252B of the pair of binoculars 220. The first reconfigurable member 250A can be positioned on or within the rear wall 210. For example, the rear wall 210 can include layers 211A, 211B which are sewn or otherwise coupled together to permanently retain the first reconfigurable member 250A within the rear wall 210. The second reconfigurable member 250B can be positioned on an upper edge 222 of the front wall 208. For example, a sleeve 244 can be sewn on or otherwise coupled to the upper edge 222 of the front wall 208 to form a channel which receives and retains the second reconfigurable member 250B within the sleeve 244.

The elements and components of the case assembly described herein can include a plurality of pockets, pouches, or compartments which are accessible to a wearer of the device. Furthermore, each of the pockets, pouches, or compartments can incorporate zippers, buttons, elastic cords, or any other mechanism configured to permit and/or restrict access to a pocket, pouch, or compartment of the case assembly. The case assembly can be made or manufactured using a plurality of materials which permit the case assembly to be utilized for the aspects described herein.

Another aspect of the present disclosure relates to a method for carrying and protecting portable optics within a case (e.g., the case assembly 100). The method can include exposing an opening 130 within a lower portion 106 of the case assembly 100 by transitioning an upper portion 104 of the case away from the opening 130. The method can also include placing a device 120 (e.g., a camera, binoculars, etc.) at least partially within an inner volume 116 defined by the lower portion 106 of the case assembly 100. The method can further include forming a reconfigurable member 150 to approximate at least a portion of the outer profile 152 of a device 120 within the case assembly 100.

Various inventions have been described herein with reference to certain specific configurations and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. A cover apparatus for carrying and protecting handheld portable devices, comprising:
   - a lower portion comprising:
     - an opening having a periphery sized and shaped to position and remove, in an upright fashion, a device insertable through the opening;
     - at least one wall defining at least a portion of the periphery of the opening, the at least one wall extending around the device in an upright position;
     - a base coupled to the at least one wall, the at least one wall and the base defining a volume within the lower portion; and
     - a reconfigurable member coupled to a portion of the at least one wall, the reconfigurable member positioned at the portion of the periphery, the reconfigurable member being formable and configurable from a first shape to a second shape different from the first shape, the second shape conforming to at least a portion of an outer profile of the device being held by the cover apparatus such that the device is maintained in the upright position within the volume of the lower portion; and
     - an upper portion operably coupled to the lower portion, the upper portion being configured to render the opening of the lower portion accessible in a first state and to position the cover over the opening in a second state;
     - wherein the reconfigurable member is independent of the upper portion and positionable to provide the first state or the second state;
     - wherein a portion of the device positionable within the lower portion comprises eve pieces that are extendable through the opening of the lower portion; and
     - wherein the reconfigurable member is conformable to a portion of the outer profile of the device spanning between the eve pieces.

2. The apparatus of claim 1, further comprising a second reconfigurable member, wherein the second reconfigurable member is configured to conform to a second portion of the outer profile of the device positioned within the lower portion.

3. The apparatus of claim 1, wherein the reconfigurable member extends around an entirety of the periphery.

4. The apparatus of claim 1, wherein the reconfigurable member is metal.

5. The apparatus of claim 1, wherein the reconfigurable member is positioned between an upper edge of the at least one wall and the base.

6. The apparatus of claim 1, wherein the reconfigurable member is positioned on an upper edge of the at least one wall.

7. The apparatus of claim 1, wherein the lower portion further includes at least one strap configured to couple the lower portion to an over-shoulder harness.

8. An apparatus for carrying and protecting portable optics, the apparatus comprising:
   - an over-shoulder harness;
   - a case assembly comprising:
     - a lower portion having at least one strap configured to couple the over-shoulder harness to the lower portion, the lower portion further comprising:

an opening sized and shaped to position and remove, in an upright fashion, a device insertable through the opening;

at least one wall having an upper edge, the upper edge of the at least one wall defining the opening, and the at least one wall extending around the device in an upright position;

a base coupled to the at least one wall, the at least one wall and the base defining a volume within the lower portion; and a reconfiqurable member coupled to a portion of the at least one wall, the reconfiqurable member extending around the upper edge of the at least one wall, the reconfiqurable member being conformable to an outer profile of the device positioned within the lower portion; and an upper portion operably coupled to the lower portion, the upper portion being configured to render the opening of the lower portion accessible in a first stat and transition to cover the opening in a second state, wherein:

the reconfiqurable member is independent of the upper portion being in the first state or the second state;

a portion of the device positionable within the lower portion comprises eye pieces that are extendable through the opening of the lower portion; and the reconfigurable member is conformable to a portion of the outer profile of the device spanning between the eye pieces.

9. The apparatus of claim 8, wherein the upper portion is operably coupled to the at least one wall.

10. The apparatus of claim 8, wherein the reconfigurable member is positioned between the upper edge of the at least one wall and a sleeve positioned on a portion of the upper edge.

11. The apparatus of claim 10, wherein the sleeve forms an elongate channel or aperture which receives at least a portion of the reconfigurable member.

12. The apparatus of claim 8, wherein:

the opening defines a first plane;

the base of the lower portion defines a second plane; and the first plane is oblique to the second plane.

13. The apparatus of claim 8, wherein the reconfigurable member is conformable to an outer profile of a pair of binoculars.

14. The apparatus of claim 8, wherein the reconfigurable member is an elongate portion of metal.

15. A method for carrying and protecting portable optics within a case, the method comprising:

exposing an opening within a lower portion of the case by transitioning an upper portion of the case from a closed state to an open state where the upper portion of the case is positioned away from the opening;

placing a device in an upright position at least partially within an inner volume defined by the lower portion of the case, wherein in the upright position, the device comprises eve pieces that extends through the opening; and forming a reconfigurable member to conform with portion of an outer profile of the device spanning between the eve pieces, wherein the reconfigurable member is independent of the upper portion and positionable to provide the closed state or the open state.

16. The method of claim 15, further comprising:

forming a second reconfigurable member to confirm with another portion of the outer profile of the device within the case.

17. The method of claim 15, further comprising:

repositioning the upper portion of the case to the closed state to at least partially cover the opening within the lower portion of the case.

18. The method of claim 15, wherein forming the reconfigurable member to conform with the outer profile of the device spanning between the eve pieces comprises curving or bending the reconfiqurable member.

19. A cover apparatus for carrying and protecting hand-held portable devices, comprising:

a main case portion;

an opening to the main case portion, the opening being defined by a periphery, and the opening being sized and shaped to position and remove, in an upright fashion, a hand-held device insertable through the opening;

a cover removably secured to the main case portion to cover the opening in a closed state and expose the opening in an open state; and a reconfigurable member secured to at least a portion of the periphery, the reconfigurable member being bendable to correspond with a profile of the hand-held device to prevent the device from moving relative to the case, wherein the reconfigurable member is independent of the cover and positionable to provide the closed state or the open state;

wherein eve pieces of the hand-held device are extendable through the opening; and wherein the reconfiqurable member is conformable to an outer profile of the hand-held device spanning between the eve pieces.

* * * * *